US008752355B2

(12) United States Patent
Moroschan

(10) Patent No.: US 8,752,355 B2
(45) Date of Patent: Jun. 17, 2014

(54) HOLLOW CORE BLOCK STABILIZATION SYSTEM

(76) Inventor: Casey Moroschan, Edmonton (CA)

( * ) Notice: Subject to any disclaimer, the term of this patent is extended or adjusted under 35 U.S.C. 154(b) by 313 days.

(21) Appl. No.: 12/644,515

(22) Filed: Dec. 22, 2009

(65) Prior Publication Data

US 2011/0146196 A1 Jun. 23, 2011

(30) Foreign Application Priority Data

Nov. 26, 2009 (CA) ..... 2686057

(51) Int. Cl.

| | |
|---|---|
| ***E04C 1/00*** | (2006.01) |
| ***E04B 2/00*** | (2006.01) |
| ***E04C 1/39*** | (2006.01) |
| ***E04B 1/00*** | (2006.01) |

(52) U.S. Cl.
USPC ..... 52/742.13; 52/309.1; 52/309.4; 52/425; 52/503; 52/505; 52/745.13; 52/742.1; 52/439

(58) Field of Classification Search
USPC ..... 52/309.1, 309.4, 425, 503, 505, 167.1, 52/742.13, 745.13, 742.1
See application file for complete search history.

(56) References Cited

U.S. PATENT DOCUMENTS

| | | | | |
|---|---|---|---|---|
| 1,377,718 | A * | 5/1921 | Morgan | 52/429 |
| 1,487,021 | A * | 3/1924 | Munson | 405/222 |
| 3,292,331 | A * | 12/1966 | Sams | 52/405.2 |
| 3,936,987 | A * | 2/1976 | Calvin | 52/309.1 |
| 4,148,166 | A * | 4/1979 | Toone | 52/309.12 |
| 4,315,391 | A * | 2/1982 | Piazza | 52/293.2 |
| 4,341,049 | A * | 7/1982 | Hsi | 52/421 |
| 4,532,745 | A * | 8/1985 | Kinard | 52/251 |
| 4,566,238 | A | 1/1986 | Janopaul, Jr. | |
| 5,450,700 | A * | 9/1995 | Hackman | 52/425 |
| 6,655,107 | B2 | 12/2003 | Dean | |
| 6,662,516 | B2 | 12/2003 | Vandehey | |
| 6,705,057 | B2 * | 3/2004 | Smyer, III | 52/606 |
| 7,934,351 | B2 * | 5/2011 | Clarno | 52/741.13 |
| 2008/0302040 | A1 | 12/2008 | Lund | |
| 2008/0307745 | A1 | 12/2008 | Lemieux | |

OTHER PUBLICATIONS

"Drilling." The American Heritage Dictionary of the English Language, Fourth Edition. Houghton Mifflin Company, 2004, May 14, 2010 <http://dictionary.reference.com/browse/drilling>.

* cited by examiner

*Primary Examiner* — Brian Glessner
*Assistant Examiner* — Omar Hijaz
(74) *Attorney, Agent, or Firm* — Christensen O'Connor Johnson Kindness PLLC

(57) ABSTRACT

A system and method of stabilizing and strengthening wall structures constructed with hollow core cementitious blocks that have not been filled with concrete. Relatively small ports are drilled at the grout line every 4-6 courses along the vertical plain of one hollow core and this and every second core is then filled with a high density expanding resin thus filling the core there by providing sufficient strength and rigidity, yet flexibility to the wall structure to withstand significant seismic activity.

13 Claims, 2 Drawing Sheets

HOLLOW CORE BLOCK STABILIZATION SYSTEM

BACKGROUND

This patent document relates to a system to reinforce cindercrete, clay or other cementitious hollow core building blocks used in the construction of walls, building and other enclosures or enclosed spaces.

Many wall structures, typically no more than three stories in height are constructed of cementitious hollow core blocks. Wall structures for schools, industrial and commercial buildings, warehouses and other structures are commonly constructed from such building material. The hollow cores are filled with concrete, insulation or are left hollow.

Concern has arisen to the stability of structures constructed with hollow core blocks located in earth quake prone zones. Since the hollow core blocks are held together with only a cementitious mortar and this mortar is typically applied only along the top exterior perimeter of the block and the two vertical faces making the "hand-hold", there is concern that seismic activity and the tremors such activity can create will collapse such rigid cementitious structures.

The inventor has proposed a solution to this problem in United States publication no. US 2009-0025333 published Jan. 29, 2009. According to this proposal, there is provided a method of stabilizing a building constructed with a wall made of stacked rows of hollow core blocks, the hollow core blocks having cores, by inserting reinforcing rods through the rows of hollow core blocks; and injecting expanding polymer resin into the hollow core blocks to fill the cores of the hollow core blocks.

SUMMARY

The inventor has now found that, surprisingly, it is not necessary to use reinforcing rods to obtain a suitable strong structure to withstand the shaking of an earthquake. Rather, injection of expanding polymer resin into the hollow core blocks will provide structural strength to reinforce a building against earthquake damage.

Thus, in one embodiment, there is provided a method of stabilizing a building constructed with a wall made of stacked rows of hollow core blocks, the hollow core blocks having cores stacked to form hollow channels extending upward through the wall, the method comprising reinforcing the wall by injecting expanding polymer resin into hollow channels of the wall but not introducing expanding polymer resin into each hollow channel of the wall. In another embodiment, there is provided a method of stabilizing structures constructed with hollow core blocks in which an expanding polymer resin is injected into every nth core of a hollow core block wall from the base of the wall to its top course, where n is two or more.

These and other aspects of the device and method are set out in the claims, which are incorporated here by reference.

BRIEF DESCRIPTION OF THE FIGURES

Embodiments will now be described with reference to the figures in which like reference characters denote like elements by way of example, and in which.

DETAILED DESCRIPTION

In the claims, the word "comprising" is used in its inclusive sense and does not exclude other elements being present. The indefinite article "a" before a claim feature does not exclude more than one of the features being present. Each one of the individual features described here may be used in one or more embodiments and is not, by virtue only of being described here, to be construed as essential to all embodiments as defined by the claims.

Figure 1:
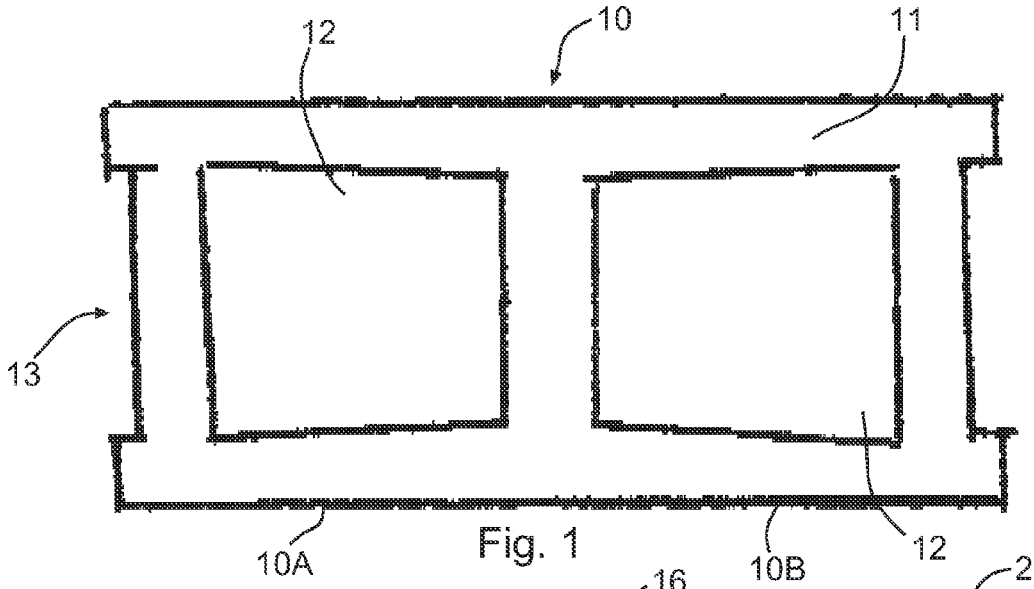
FIG. 1 is a cross section of a hollow core block.
Figure 2:
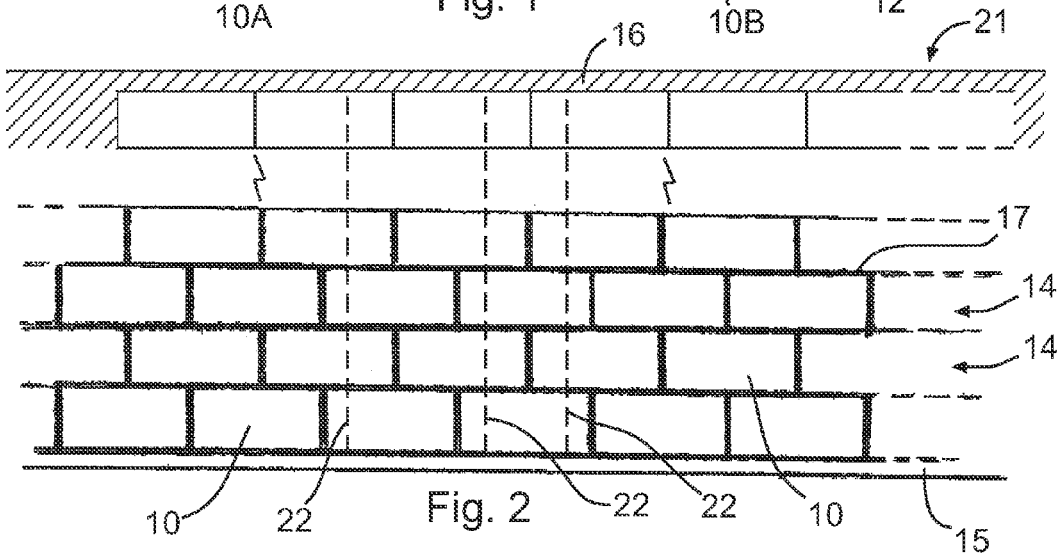
FIG. 2 is a side view of a wall configuration of hollow core blocks.
Figure 3:
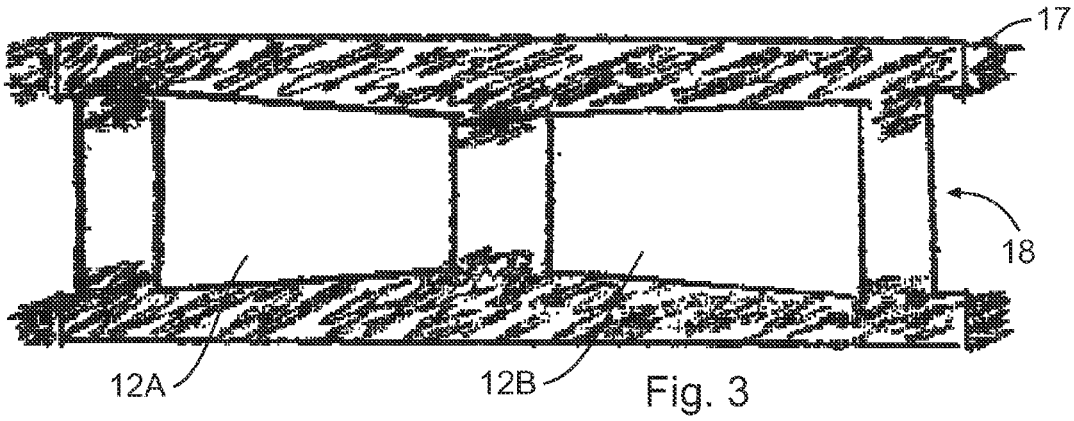
FIG. 3 is a section of block showing where mortar is typically applied to bind the blocks together.

FIG. 1 shows a hollow core block 10 is made of a cementitious or clay shell 11, which surrounds a hollow core 12 and as typically is the case in hollow core block manufacture there is a handhold 13 which is simply a hollow along the outside ends of the individual blocks 10. FIG. 2 shows a wall 21 made using hollow core blocks 10 in a series of courses 14. A foundation 15 supports the hollow core blocks 10 and the hollow core blocks may extend upward to a roof 16. Grout lines along the vertical and horizontal planes of the hollow core blocks 10 are filled with mortar 17 to cement the hollow core blocks 10 together. FIG. 3 shows the typical application of mortar 17 to the hollow cores blocks 10 with resultant gaps 18 between the handholds 13 of adjacent blocks 10 and between the horizontal faces (top and bottom) of each hollow core block 10. Each block 10 typically is rectangular in cross-section, formed of two halves 10A and 10B, having respective cores 12A and 12B. When the blocks 10 are vertically stacked to form a wall with multiple courses 14 the cores 12A, 12B of vertically adjacent blocks 10 are aligned to form vertical channels 22 extending up through the wall 21.

Figure 4:
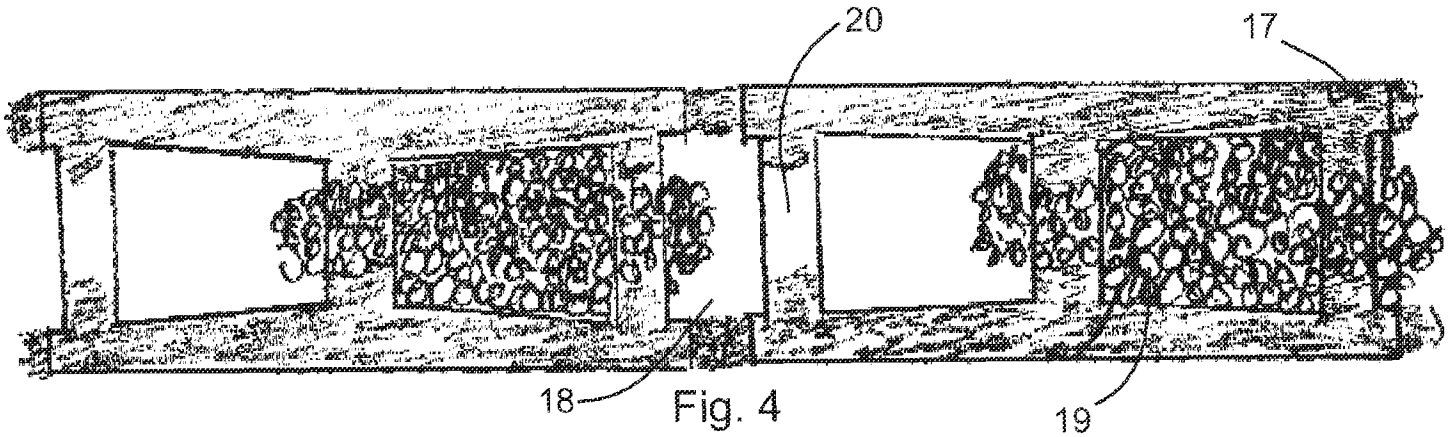
FIG. 4 is a cross section of two blocks showing how the expanding resin flows and grasps the adjacent block.

FIG. 4 shows a cross section of a treated hollow core block 10. Expanding resin 19 fills a single hollow core 12 of each hollow core block 10 and as the expanding resin 19 expands it not only fills the hollow core block hollow cores 12 but also fills or partially fills the voided or hollow areas 20 of the stacked hollow core blocks 10, thus binding vertically adjacent blocks 10 together.

Figure 5:
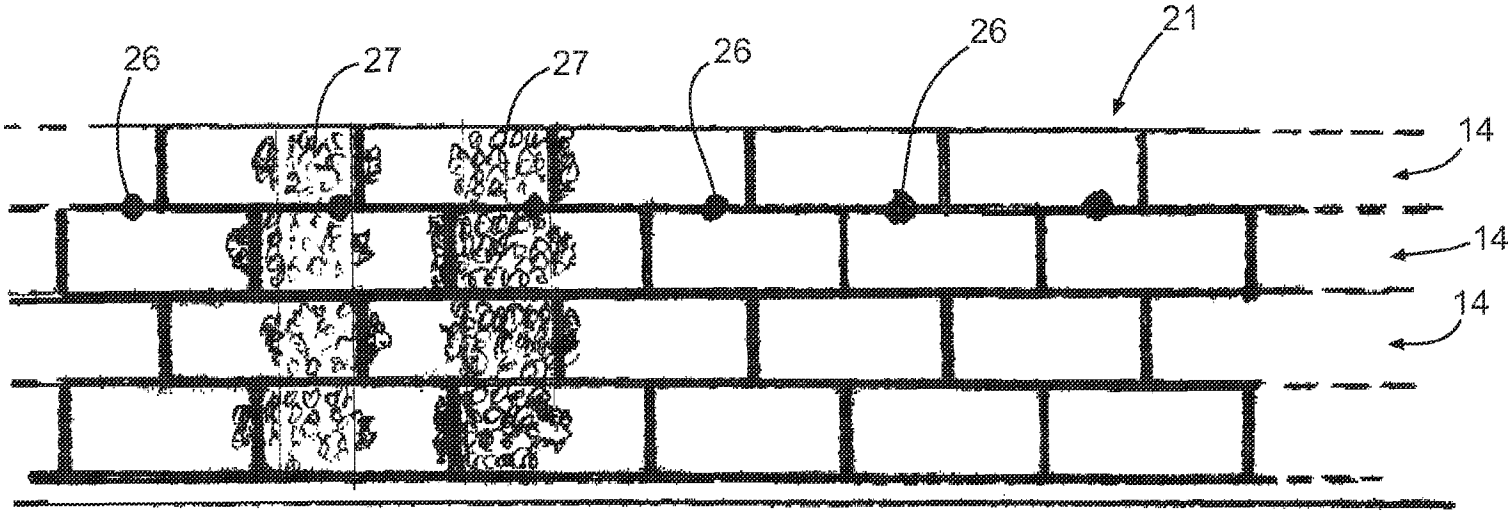
FIG. 5 is side view of a wall configuration with ports for supplying the expanding polymer resin into every second core of the block wall.

FIG. 5 shows a wall 21 with ports 26 drilled through the hollow core blocks 10 into every second hollow core 12 with the typically no larger than ¾" diameter ports 26 typically drilled through the mortar 16 to minimize damage to the hollow core blocks 10. Various sizes of ports may be used depending on the material making up the hollow core block. An expanding polymer resin 19 is injected into every second hollow core 12 completely filling the hollow core 12 from the base of the wall to the top of the wall thereby forming a continuous expanded foam column 27 within the hollow cores 12 being treated.

Depending upon the height of the wall structure 21, two or more injection ports may have to be drilled to access the hollow channel of a stack of hollow core blocks 10. A single hole may suffice at the top of the wall, but multiple holes, for example at intervals of 4-6 courses, may be required if the resin cures too quickly to flow throughout the height of a wall 21. The high density expanding polymer resin is then injected into the hollow core 12 and the aggressive expansive nature of the resin will fill the cores as well as flow over into the handholds 13 and voided or gap areas 20 created in the laying of the hollow core blocks 20 thereby providing significantly increased rigidity to the wall structure in case of seismic activity. An additional benefit is also the fact that hollow core blocks 20 are typically relatively porous and the aggressive nature of the expanding polymer resins will fill the pores and effectively bind the cementitious shells 11 of adjacent blocks 10 together.

Using expanding polymer resin provides an effective method of stabilizing and strengthening wall structures constructed of hollow core block. There are additional benefits of using expanding polymer resin. The extremely light weight nature of the expanding polymer resins doers not add significant weight to an existing foundation system that may not be designed to carry additional loading. The very high R-value of the expanding resin will provide additional thermal protection to the structure. The expanding polymer resins also have excellent sound attenuation characteristics and as such will provide increased sound insulation to treated walls. Additionally, the treatment of walls using expanding polymers is extremely quick and non-intrusive.

Expanding polymer resin, being flexible and not brittle, will not break under conditions where hollow or cement filled cementitious locks will break. For example, during an earthquake, cementitious filled or hollow blocks are brittle and may collapse dramatically within a short period of time. Blocks having hollow channels that are filled with expanding polymer resin will sway together and be bound as a cohesive structure rather than collapsing providing significantly more valuable time to evacuate buildings constructed with hollow core block and which are under seismic attack.

The expanding polymer resin referenced in this patent application may be of many different types. One example of an expanding polymer resin that may be used to fill the hollow channels is a high density polyurethane foam system. Preferably, the high density polyurethane foam has a compressive strength greater than 30 psi, and may also have a compressive strength greater than 60 psi or 100 psi.

The method of reinforcement disclosed here is particularly applicable to buildings located in an earthquake prone area. An earthquake prone area is an area where an earthquake with a shaking force of more than 16% g (where g is gravity) has a more than 2% chance of occurring in a 50 year period.

The wall structures treated with the reinforcing method may be walls of a multi-story building and may extend from a foundation to a roof and the expanding polymer resin is injected into the hollow channels of the wall to fill the respective hollow channels from the foundation to the roof. The building may be reinforced and thus stabilized after the roof is in position on the wall, thus being a retrofit.

The spacing of the channels 22 selected for forming into columns 27 may depend on the application. The exemplary embodiment shown here is of evenly spaced columns, where every second hollow core 12 in a course 14 is filled with the expanding polymer resin. In some instances, it may be possible to strengthen the wall with each nth core 12 filled with expanding polymer resin, for example every third, or fourth or more core, but the resulting structure should be carefully assessed to ensure it meets local building codes. In addition, even in the structure where every nth core is filled with expanding polymer resin, some adjacent cores may be filled. In general, it is desirable that each block 12 have at least one of its cores 12A or 12B filled with expanding polymeric resin.

The following sequences specify possible filled core sequences along a course 14 where not every channel is filled with expanding polymer resin. Since courses 14 stack with aligned cores to form walls 21 the sequences also specify the sequence of filled (1) and void or partially filled channels (0) along a wall 21. Exemplary sequences: 1-0-1-0-1-0 . . . (the exemplary embodiment); 1-0-1-1-0-1-1-0-1-1-0 . . . ; 1-0-0-1-0-0-1-0-0 . . . (every third channel filled, but this is not so desirable because every third block in a course has no cores filled); 1-1-0-1-1-1-0-1-1-1-0-1-1-1-0-1 . . . The principle to be followed is that enough channels are filled to meet necessary strength requirements but not every hollow channel is filled so that the process is economical. Preferably, no reinforcement rods are used, as they are not necessary and add expense, although the polymer may have included within it some kind of reinforcement material such as embedded fibres.

The ports created in the hollow shells may be created by drilling, chiseling, chopping, coring, punching, hammering or any other method. The cementitious block in this patent application may be any type of hollow core block used for constructing buildings, for example including concrete, cindercrete or clay blocks.

Immaterial modifications may be made to the embodiments described without departing from what is covered by the claims.

What is claimed is:

1. A method of stabilizing a building against earthquake damage, the building being constructed with a wall made of stacked rows of hollow core blocks, the hollow core blocks being made of concrete, cindercrete or clay, the hollow core blocks having cores stacked to form hollow channels extending upward through the wall, the method comprising:

reinforcing the wall by creating respective injection ports in or between shells of selected hollow core blocks, in which each injection port provides an injection point for a corresponding hollow channel extending upward through the wall, and injecting expanding polymer resin into the corresponding hollow channels of the wall through the respective injection ports to fill the corresponding hollow channels to create filled channels but not injecting expanding polymer resin through an injection port into each hollow channel of the wall such that there are unfilled hollow channels that are not filled with expanding polymer resin, with at least some of the filled channels being adjacent to and connected by openings to a corresponding one of the unfilled hollow channels, the expanding polymer resin being injected into the at least some of the filled channels to fill the cores of the filled channels and flow over into the openings to bind the hollow core blocks together.

2. The method of claim 1 in which the filled channels are evenly spaced.

3. The method of claim 2 in which the filled channels alternate with unfilled hollow channels.

4. The method of claim 1 in which the expanding polymer resin is a closed cell expanding polyurethane foam having a compression strength greater than 40 psi.

5. The method of claim 1 in which the expanding polymer resin is a closed cell expanding polyurethane foam having a compression strength greater than 60 psi.

6. The method of claim 1 in which the expanding polymer resin is a closed cell expanding polyurethane foam having a compression strength greater than 100 psi.

7. The method of claim 1 in which the wall extends from a foundation to a roof and the expanding polymer resin is injected into the hollow channels to fill the respective hollow channels from the foundation to the roof.

8. The method of claim 1 in which the building has a roof and is stabilized by the step of reinforcing the wall after the roof is in position on the wall.

9. The method of claim 1 in which at least one core of each hollow core block in the wall is filled with expanding polymer resin.

10. The method of claim 1 further comprising:

reinforcing the wall without addition of reinforcement rods into the hollow channels of the wall.

11. The method of claim 1 in which creating the injection ports comprises creating injection ports in shells of the hollow core blocks.

12. The method of claim 1 in which creating the injection ports comprises creating injection ports through mortar between shells of the hollow core blocks.

13. The method of claim 1 in which creating the injection ports comprises drilling, chiseling, chopping, coring, punching, or hammering injection ports in or between shells of the hollow core blocks.

* * * * *